US011179587B2

(12) United States Patent
Goldwitz

(10) Patent No.: US 11,179,587 B2
(45) Date of Patent: Nov. 23, 2021

(54) TRAMPOLINE COVERINGS AND TRAMPOLINES INCLUDING TRAMPOLINE COVERINGS

(71) Applicant: Brian Goldwitz, New Haven, CT (US)

(72) Inventor: Brian Goldwitz, New Haven, CT (US)

( * ) Notice: Subject to any disclaimer, the term of this patent is extended or adjusted under 35 U.S.C. 154(b) by 0 days.

(21) Appl. No.: 15/818,729

(22) Filed: Nov. 20, 2017

(65) Prior Publication Data

US 2018/0140882 A1 May 24, 2018

Related U.S. Application Data

(60) Provisional application No. 62/425,031, filed on Nov. 21, 2016.

(51) Int. Cl.

| | |
|---|---|
| ***A63B 5/11*** | (2006.01) |
| ***A63B 71/02*** | (2006.01) |
| ***A63B 71/00*** | (2006.01) |
| ***E04H 15/02*** | (2006.01) |
| *E04H 15/24* | (2006.01) |

(52) U.S. Cl.

CPC ..... *A63B 5/11* (2013.01); *A63B 71/0036* (2013.01); *A63B 71/022* (2013.01); *E04H 15/02* (2013.01); *A63B 2071/009* (2013.01); *A63B 2208/0242* (2013.01); *A63B 2208/12* (2013.01); *A63B 2209/00* (2013.01); *A63B 2210/50* (2013.01); *E04H 15/24* (2013.01)

(58) Field of Classification Search

CPC ..... A63B 5/11; A63B 71/022; A63B 71/0036; A63B 2208/0242; A63B 2208/12; A63B 2071/009; A63B 2209/00; E04H 15/02; E04H 15/24

See application file for complete search history.

(56) References Cited

U.S. PATENT DOCUMENTS

| | | | | |
|---|---|---|---|---|
| 4,433,838 A * | 2/1984 | Gordon | ..... | A63B 5/11 473/473 |
| 5,711,743 A * | 1/1998 | Nichols, Jr. | ..... | A63B 5/11 135/133 |
| 6,053,845 A | 4/2000 | Publicover et al. | | |

(Continued)

FOREIGN PATENT DOCUMENTS

| | | | | |
|---|---|---|---|---|
| WO | WO-2009097826 A1 * | 8/2009 | ..... | A63B 5/11 |

OTHER PUBLICATIONS

PCT/US17/62906. Int'l Search Report & Written Opinion (dated Mar. 6, 2018).

*Primary Examiner* — Garrett K Atkinson
*Assistant Examiner* — Zachary T Moore
(74) *Attorney, Agent, or Firm* — Julio Loza; Tyler Barrett; Loza & Loza, LLP

(57) ABSTRACT

Trampolines may include a frame, a bounce mat coupled to the frame, and a plurality of poles coupled to the frame. A cover may be disposed over at least a portion of the bounce mat and retained in an at least partially suspended position utilizing the plurality of poles. Trampoline may be utilized by coupling a bounce mat to a frame. A plurality of poles may also be coupled to the frame. A cover may be disposed over at least a portion of the bounce mat utilizing the plurality of poles to retain the cover suspended over the at least a portion of the bounce mat. Other aspects, embodiments, and features are also included.

4 Claims, 9 Drawing Sheets

(56) References Cited

U.S. PATENT DOCUMENTS

| | | | | |
|---|---|---|---|---|
| 6,988,967 | B2 * | 1/2006 | Allison | A63B 5/11 473/469 |
| 7,762,927 | B1 * | 7/2010 | Gordon | A63B 5/11 482/27 |
| 2011/0039660 | A1 | 2/2011 | Publicover | |

* cited by examiner

TRAMPOLINE COVERINGS AND TRAMPOLINES INCLUDING TRAMPOLINE COVERINGS

PRIORITY CLAIM

The present Application for Patent claims priority to Provisional Application No. 62/425,031 entitled "Trampoline Coverings and Trampolines Including Coverings" filed Nov. 21, 2016.

TECHNICAL FIELD

The technology discussed below relates generally to trampolines, and more specifically to trampoline coverings, and trampolines with such coverings.

BACKGROUND

Trampolines are found and used in a variety of environments. Typically, however, trampolines are found in the backyards of homes where they are primarily used by children. In such an environment, a trampoline is typically openly exposed to natural elements such as rain, snow, sun, wind, and the like. To protect the trampoline from such elements when not in use, covers have been placed over trampolines. Conventional covers typically comprise canvas or plastic sheets which are simply tied or secured over the top of the trampoline. Although useful in achieving one objective, simply placing a cover over the trampoline does not achieve other objectives which are often desirable to a homeowner. For example, at times it is desirable to prevent unwanted access to the trampoline. Simply placing a cover over the trampoline does not prevent unwanted use since individuals can still jump on the trampoline with the cover attached thereto.

In addition, it is often desirable for children or adults to sleep on the bed of the trampoline. In such situations, it is often beneficial to have a cover which can not only protect those sleeping on the trampoline from the weather, but will also close off the trampoline from bugs and insects. It would also be beneficial if the trampoline cover would help prevent children from rolling off the trampoline.

Although prior uses have placed conventional tents on trampolines, such a combination creates its own problems. For example, most tents are typically difficult and time consuming to both assemble and disassemble. Furthermore, the tent is generally required to be fully disassembled to enable conventional use of the trampoline. This is especially bothersome if it is desirable to set the tent up each night and then take the tent down each morning.

BRIEF SUMMARY OF SOME EXAMPLES

The following summarizes some aspects of the present disclosure to provide a basic understanding of the discussed technology. This summary is not an extensive overview of all contemplated features of the disclosure, and is intended neither to identify key or critical elements of all aspects of the disclosure nor to delineate the scope of any or all aspects of the disclosure. Its sole purpose is to present some concepts of one or more aspects of the disclosure in summary form as a prelude to the more detailed description that is presented later.

According to one or more aspects of the present disclosure, trampolines with coverings are disclosed. According to at least one embodiment, such trampolines may include a frame, a bounce mat coupled to the frame, and a plurality of poles coupled to the frame. A cover may be disposed over at least a portion of the bounce mat and retained in an at least partially suspended position utilizing the plurality of poles.

Additional aspects of the present disclosure include methods of using a trampoline. According to at least one example, such methods may include coupling a bounce mat to a frame. A plurality of poles may be coupled to the frame. A cover may be disposed over at least a portion of the bounce mat utilizing the plurality of poles to retain the cover suspended over the at least a portion of the bounce mat.

Other aspects, features, and embodiments associated with the present disclosure will become apparent to those of ordinary skill in the art upon reviewing the following description in conjunction with the accompanying figures.

DRAWINGS

DETAILED DESCRIPTION

The illustrations presented herein are, in some instances, not actual views of any particular trampoline or trampoline cover, but are merely idealized representations which are employed to describe the present disclosure. Additionally, elements common between figures may retain the same numerical designation.

Figure 1:
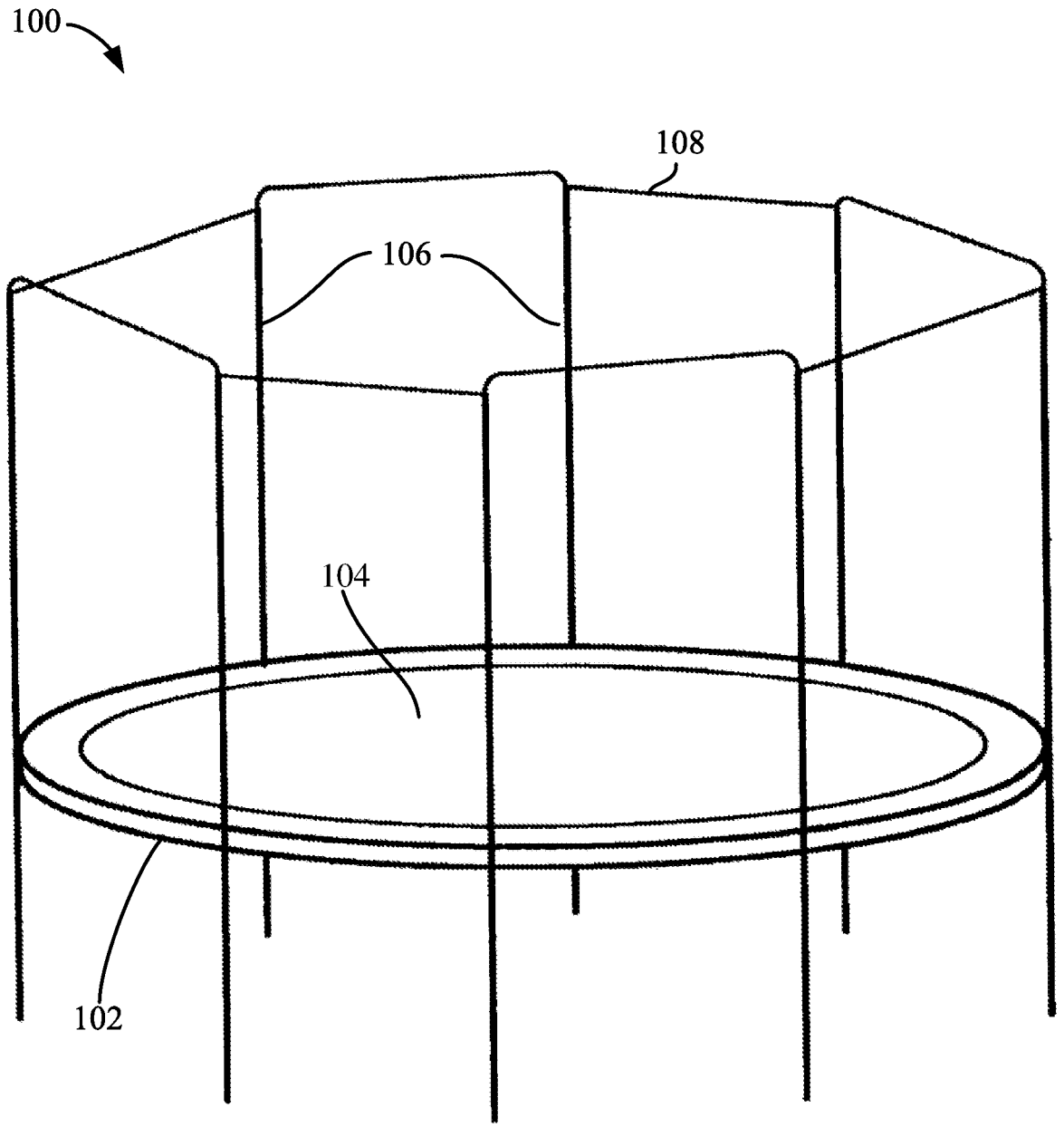
FIG. 1 is a view of a trampoline according to at least one embodiment.

Various embodiments of the present disclosure include trampolines configured to employ a cover. Referring to FIG. 1, a view of a trampoline 100 is depicted according to at least one embodiment. As shown, a trampoline 100 can include a frame structure 102 with a bounce mat 104 coupled to the frame structure 102. The frame structure 102 typically includes legs and an outer frame in a particular shape for the trampoline (e.g., round, hexagonal, rectangular). Usually, the bounce mat 104 is coupled to the frame structure 102 by springs (not shown). In some embodiments, the trampoline can also include an enclosure configured to inhibit a user from falling off of the trampoline 100. In the depicted example, the trampoline 100 includes an enclosure including a plurality of upright rods or poles 106 coupled to the frame structure 102. An enclosure material 108 is coupled to the upright rods or poles 106 and surrounds the bounce mat 104. The enclosure material 108 may, in at least some embodiments, be made from a net material.

According to at least one example of the present disclosure, a cover can be disposed over at least a part of the bounce mat 104, where the cover is retained in at least a partially suspended position utilizing the plurality of pole 106. In one or more examples, the cover can be retained in the at least partially suspended position by the plurality of poles 106 pivoted to a hinged position leaning toward a central area of the bounce mat 104. In other examples, the cover can be retained in the at least partially suspended position utilizing the poles 106 with a respective cord coupled between each pole 106 and a central portion of the cover.

Figure 2:
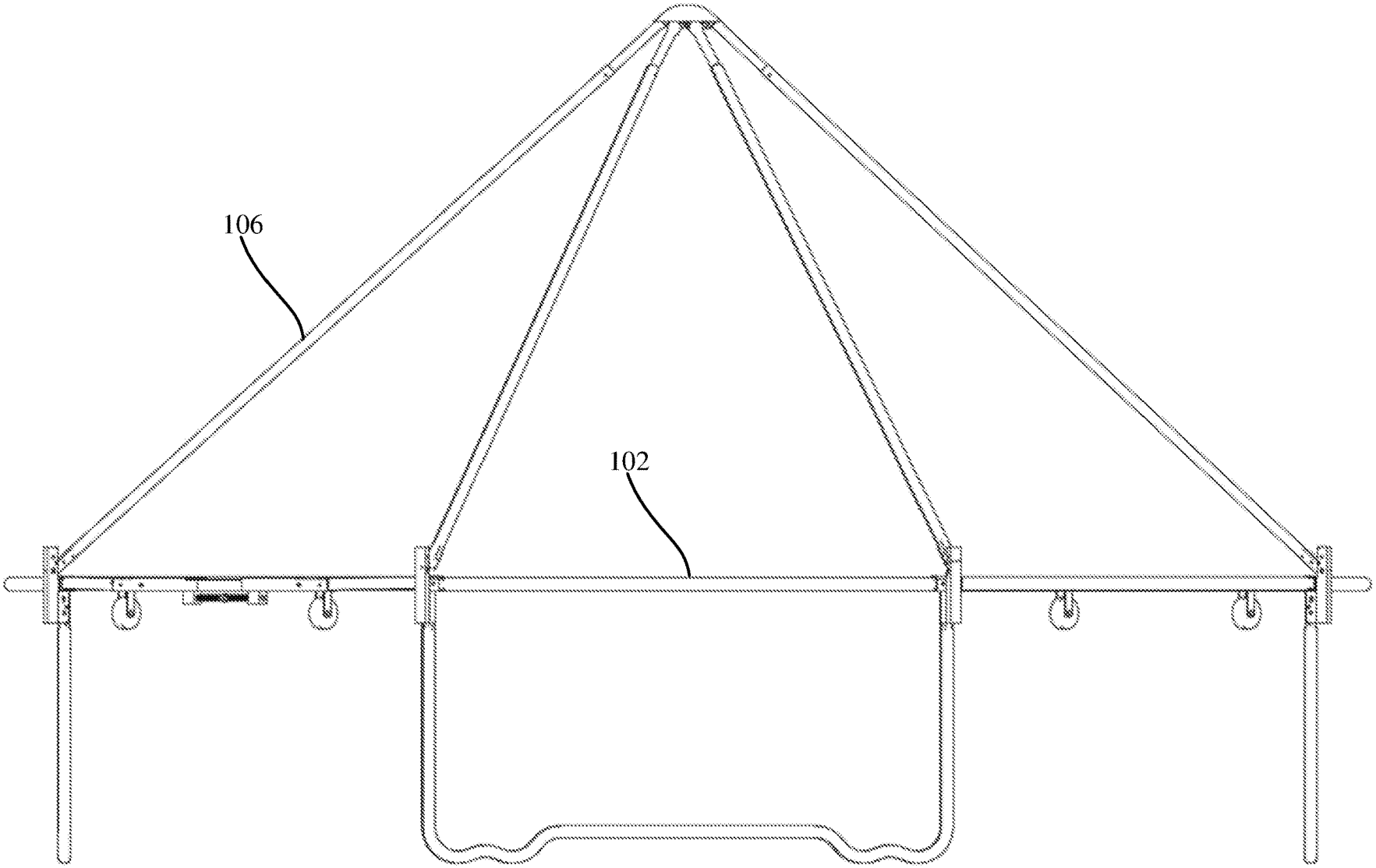
FIG. 2 is a side view of a trampoline according to at least one embodiment with poles hingedly coupled to the frame structure.
Figure 3:
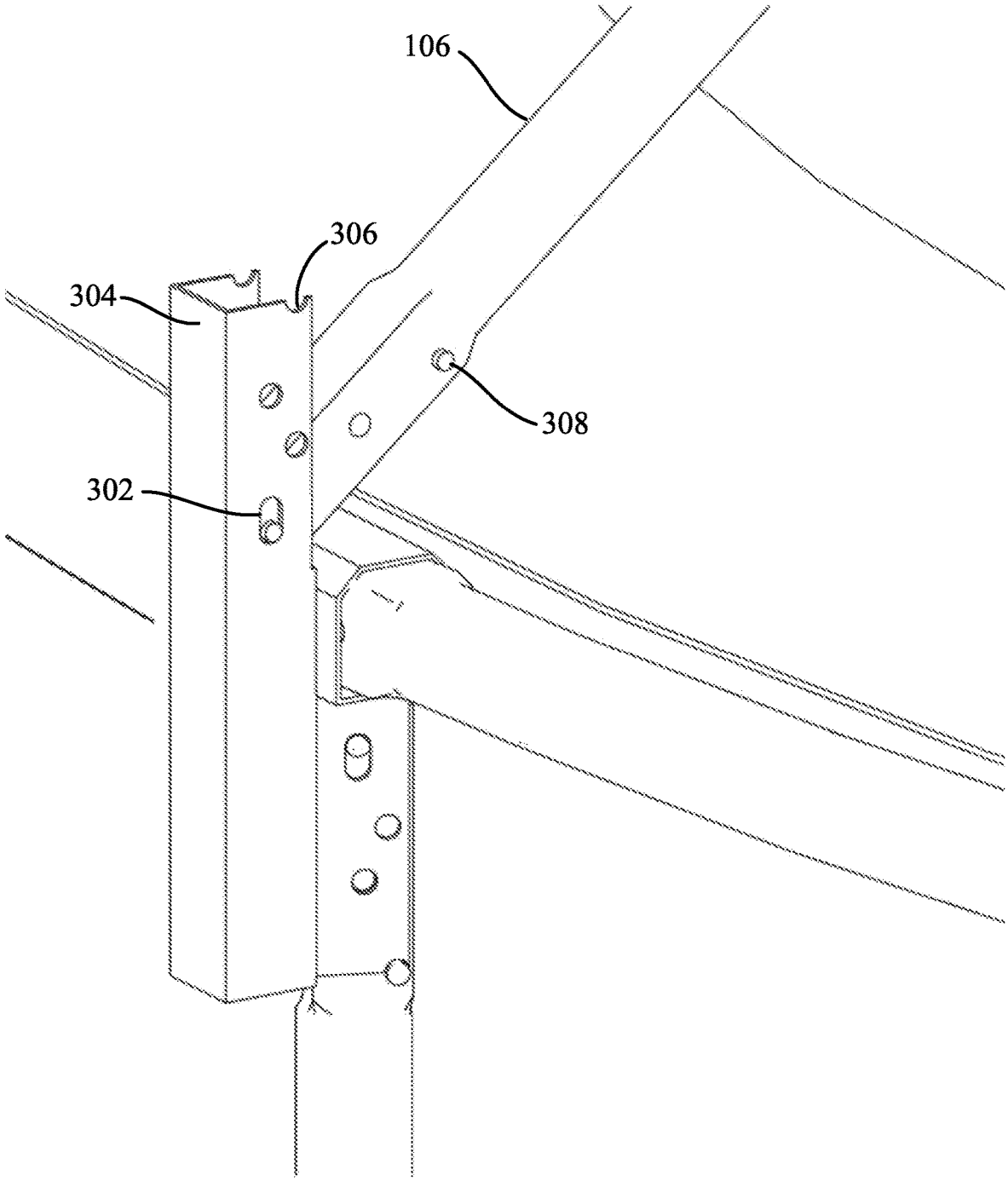
FIG. 3 is a side view of a hinged connection according to at least one embodiment of the disclosure.

FIG. 2 is a side view of a trampoline 100 according to at least one embodiment with poles 106 hingedly coupled to the frame structure 102. As shown, the poles 106 can be rotated inward toward a central area of the trampoline 100. A close-up of a hinged connection is shown in FIG. 3. As shown, the pole 106 includes a hinge aperture that is aligned with a hinge aperture 302 in a connector 304. A rod or bolt can be positioned through the hinge aperture 302 and through an aligned aperture on the poles 106, facilitating the hinged connection of the poles 106 to the frame structure 102. The connector 304 can include a locking aperture 306 to lock the poles 106 in the upright position when used for an enclosure. In one embodiment, another rod can be placed through the locking aperture 306 and an aligned locking aperture 308 in the poles 106. In other embodiments, a spring-loaded pin can be positioned in the locking aperture 308 of the pole. When the spring-loaded pin is aligned with the locking aperture 306 in the connector 304, the pin will displace into the locking aperture 306 in the connector 304 to lock the poles 106 in the upright position. To unlock the poles 106, a user can push the spring-loaded pin inward through the aperture 306 in the connector 304 to release the poles 106.

Figure 4:
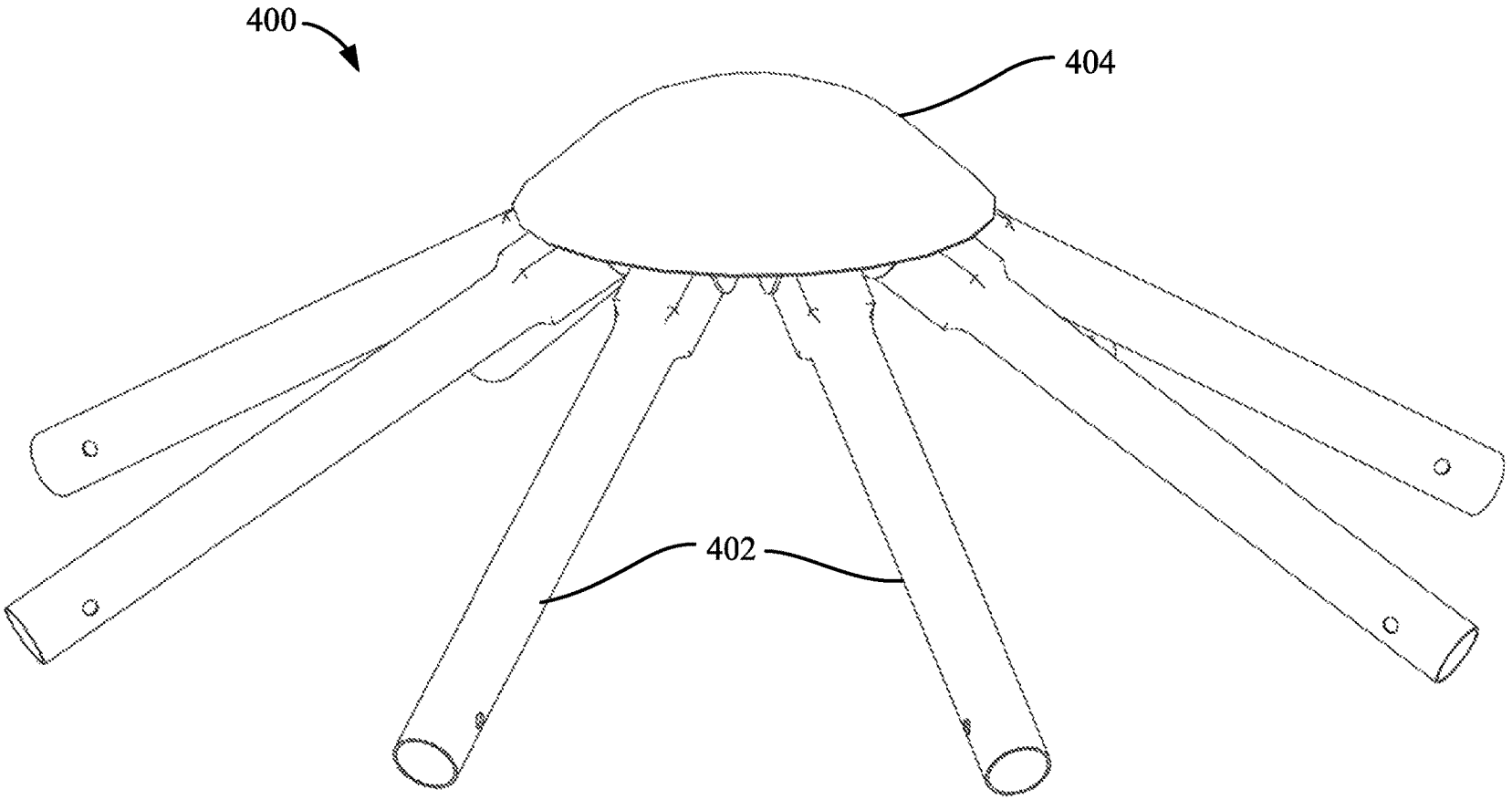
FIG. 4 is an isometric view of a top cap according to at least one embodiment of the present disclosure.
Figure 5:
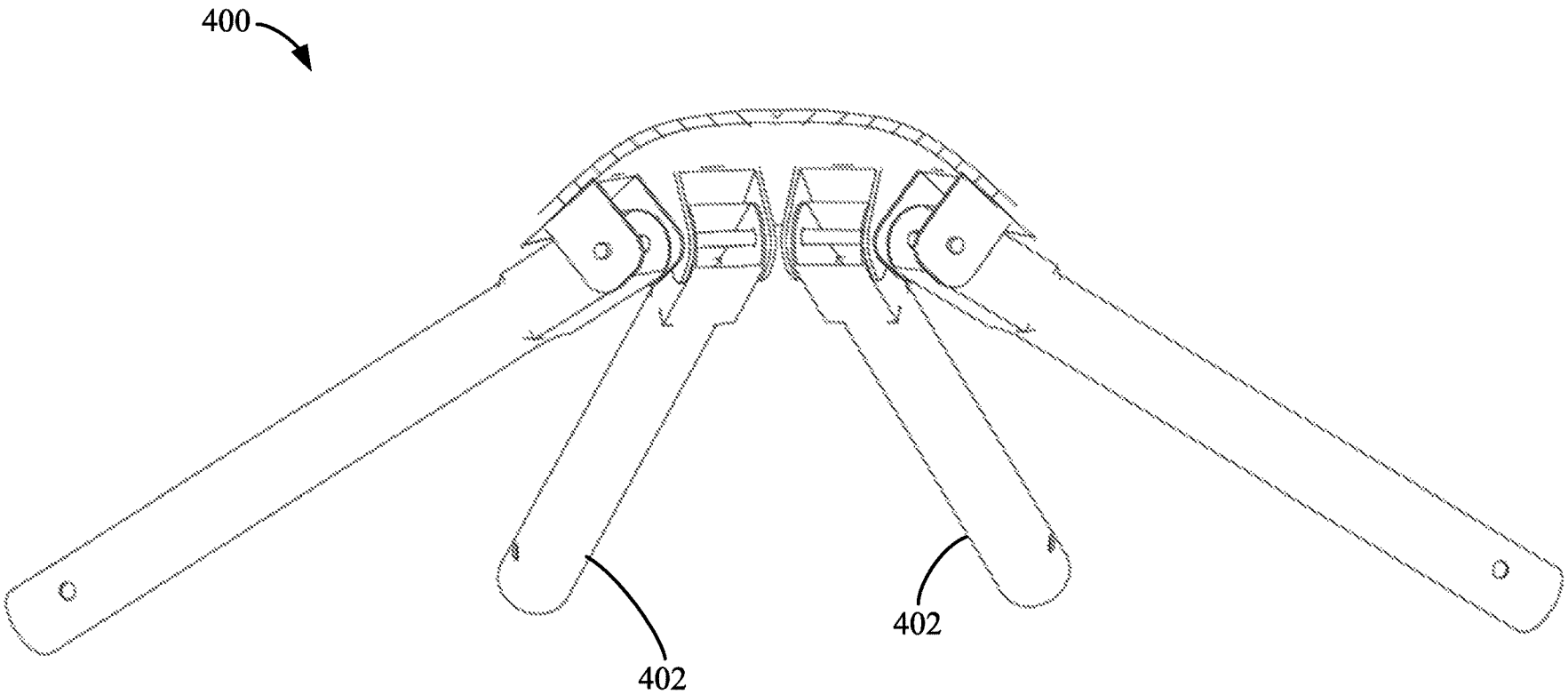
FIG. 5 is a cross-sectioned side view of the top cap according to at least one embodiment of the present disclosure.

When the poles 106 are hinged inward, the poles form a teepee shape over the bounce mat 104. To retain the poles 106 in the inward position, a top cap can be employed. FIG. 4 is an isometric view of a top cap 400 according to at least one embodiment of the present disclosure, and FIG. 5 is a cross-sectioned side view of the top cap 400. The top cap 400 includes a plurality of pole connectors 402 each positioned to align with a respective pole 106. Each pole connector 402 is configured to be coupled to a respective pole 106 to secure the cover structure when the poles 106 are hinged inward. According to at least one embodiment, one of the either pole connector 402 or the pole 106 may include a longitudinal end that is sized to fit within the longitudinal end of the other of the pole connector 402 or the pole 106. For example, the longitudinal end of the pole 106 may include a diameter that is sized to fit within the diameter of the pole connector 402 to facilitate coupling the pole connector 402 with the pole 106.

Figure 6:
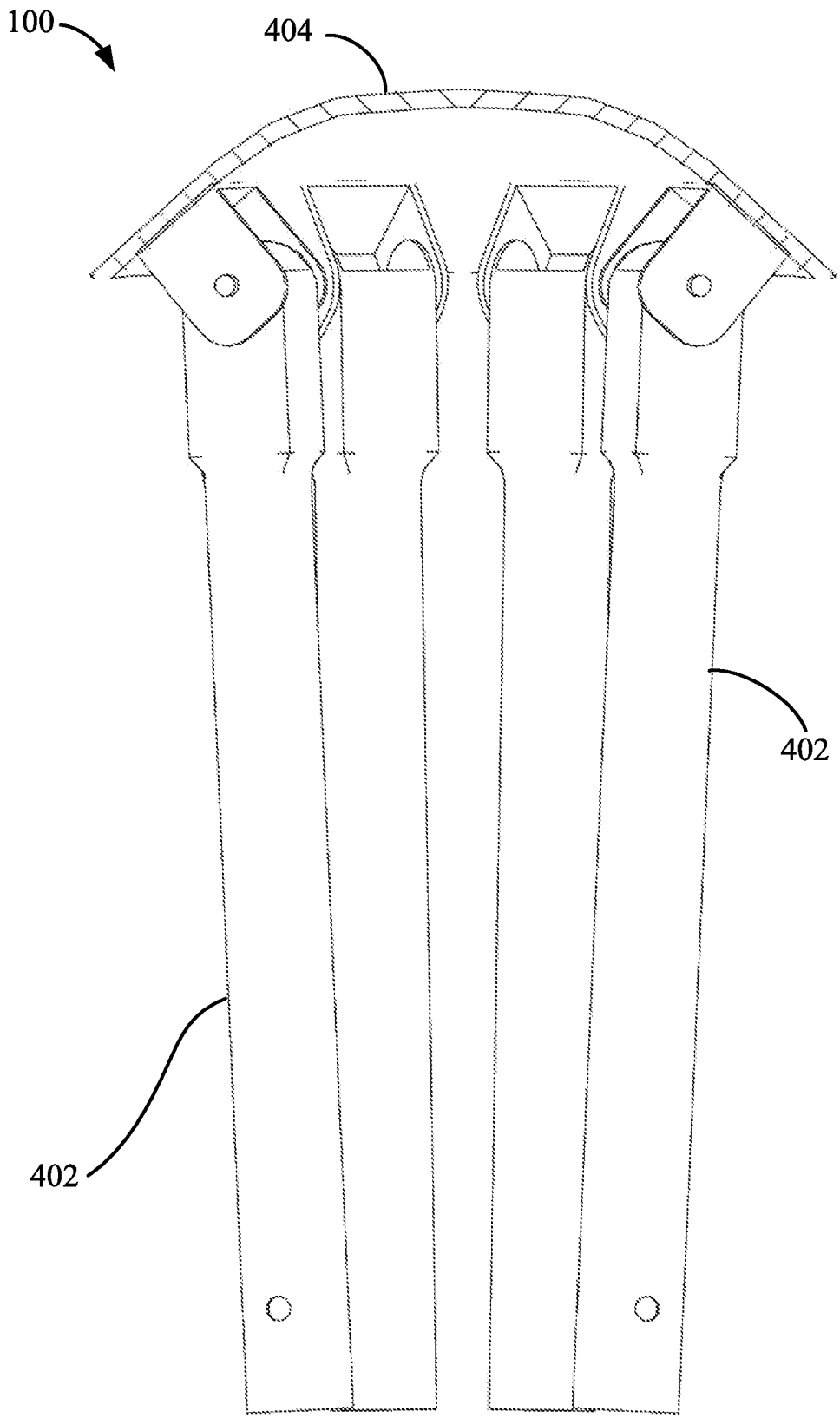
FIG. 6 is a cross-sectioned side view of the top cap according to at least one embodiment of the present disclosure.

As shown in FIG. 5, the pole connectors 402 can be hingedly coupled to a cap 404. In this way, the pole connectors 402 can be angled to fit any angle needed to connect to the respective poles 106. Additionally, the pole connectors 402 can be hinged downward for storage, as shown in the side cross-sectioned view in FIG. 6.

Figure 7:
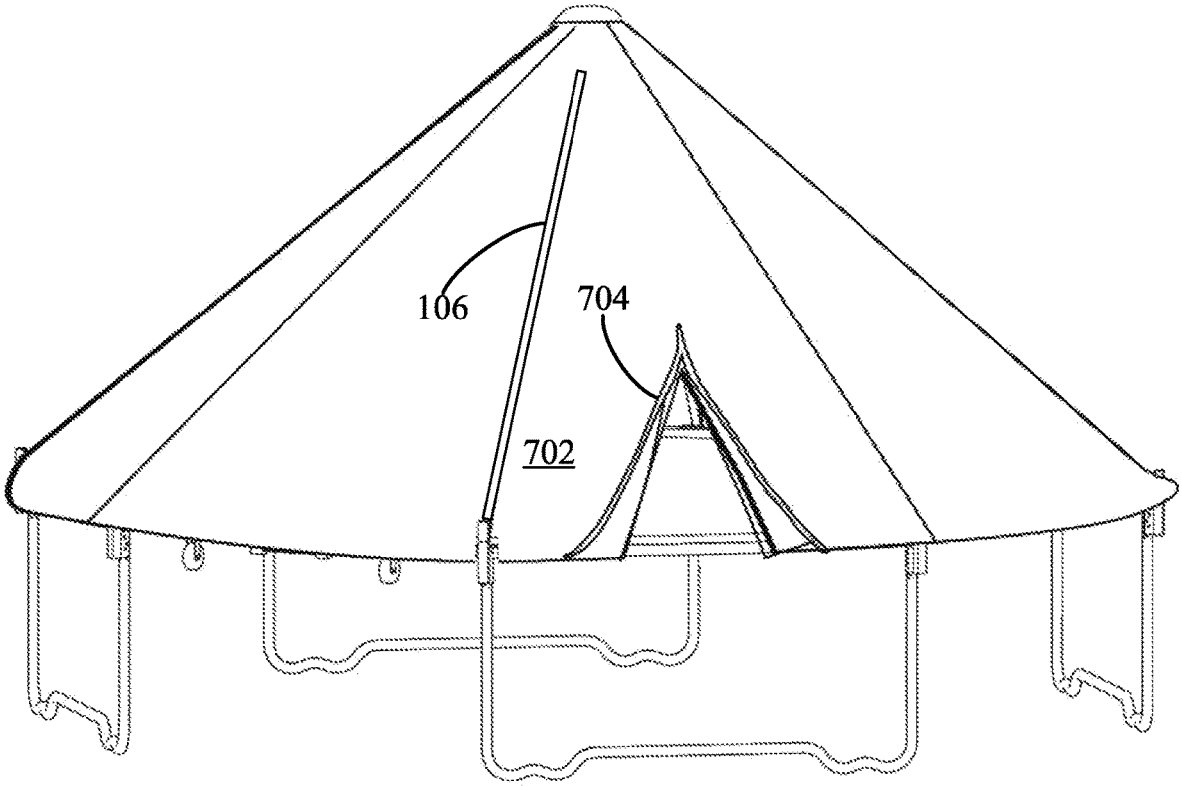
FIG. 7 is a side view of a trampoline according to at least one example with a cover positioned over the bounce mat.

When the poles 106 are all hinged inward and secured with the top cap 400, a cover can be positioned over an area of the trampoline 100 and secured in place by the poles 106 and top cap 400 to at least substantially enclose an area of the bounce mat 104. FIG. 7 is a side view of a trampoline 100 according to at least one example with a cover 702 positioned over the bounce mat 104. In the example in FIG. 7, the cover 702 is positioned on top of most of the poles 106 and the top cap 400. In other embodiments, the cover 702 can be positioned under the poles 106, and coupled to the poles 106 to keep the cover 702 up. In FIG. 7, one pole 106 is shown positioned over the cover 702 to depict such an example.

As shown, the cover 702 may include a door 704 to enable users to enter and exit the cover 702. The door 704 can be closed and secured, such as by a zipper or other suitable closure mechanism.

Figure 8:
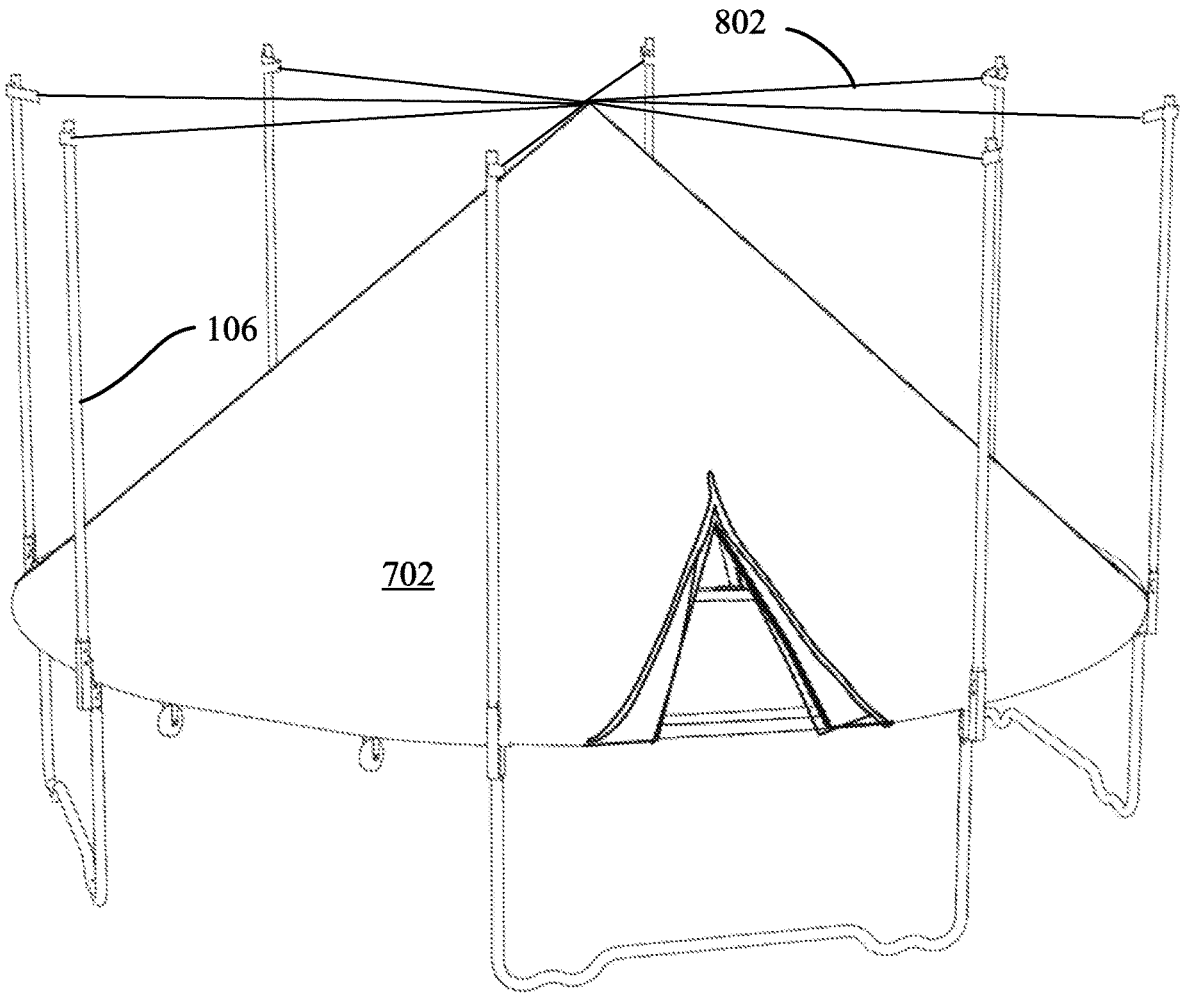
FIG. 8 is a side view of another embodiment of a trampoline and cover according to at least one example.

FIG. 8 is a side view of a trampoline 100 according to at least one embodiment with cords 802 coupled between the poles 106 and a central portion of the cover 702. As depicted, the upright poles 106 can remain in the upright position. In this embodiment, a respective cord 802 is coupled between each pole 106 and a central portion of the cover 702. The cords 802 can lift the central portion of the cover 702 to form a similar teepee shaped cover as the other embodiments.

Figure 9:
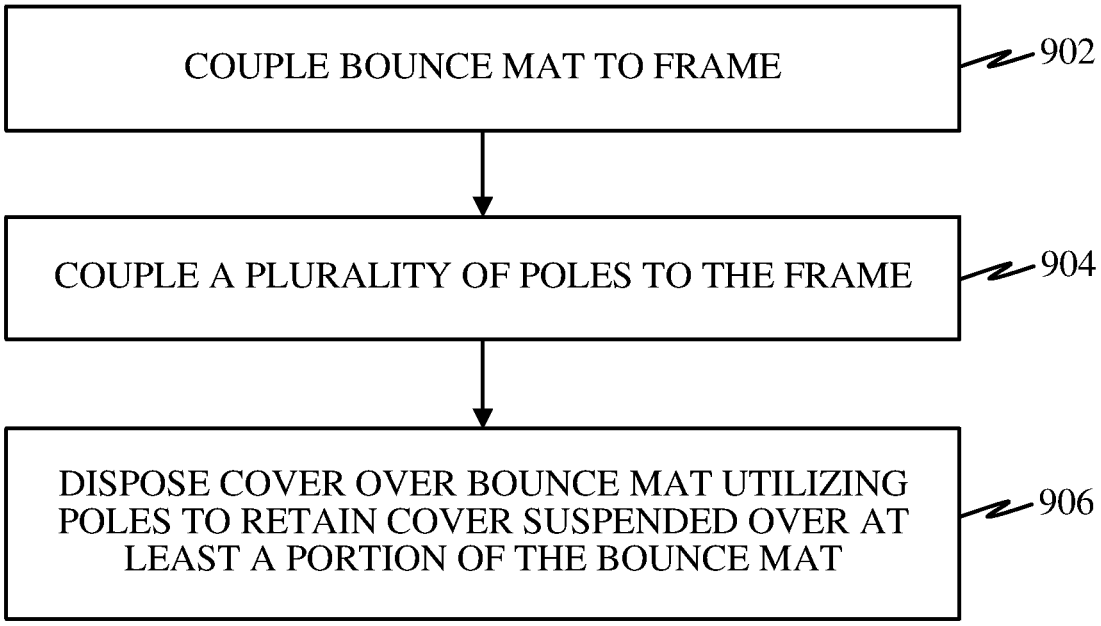
FIG. 9 is a flow diagram illustrating a method of using a trampoline according to at least one embodiment of the present disclosure.

FIG. 9 is a flow diagram illustrating at least one example of a method of using a trampoline according to the present disclosure. With reference to FIGS. 1-5, 8, and 9, a user can couple the bounce mat 104 to the frame 102 at 902. As noted previously, the bounce mat 104 may be coupled to the frame 102 utilizing springs extending between the bounce mat 104 and the frame 102.

At 904, the poles 106 may be coupled to the frame. In one example, the poles 106 may be hingedly coupled to the frame. In such examples, the poles 106 can be adjusted from an upright position (e.g., extending generally vertical) to an angled position (e.g., extending generally toward a central area of the bounce mat 104). In at least one such example, the poles 106 can be adjusted by releasing a locking mechanism (e.g., a rod or pin) extending through a locking aperture 306 of a connector 304, and subsequently rotating each pole 106 about a rod extending through a hinge aperture 302 in the connector 304 and an aligned hinge aperture in the pole 106.

At 906, the cover 702 can be disposed over at least a portion of the bounce mat 104 utilizing the poles 106 to suspend the cover 702 over at least a portion of the bounce mat 104. In embodiments where the poles can be hinged, a top cap 400 may be coupled to the plurality of poles 106. The cover 702 can be disposed over the poles 106, or the cover 702 may be disposed under the poles 106. In embodiments where the poles 106 remain upright, a respective cord 802 may be coupled to each respective pole 106 and to a central portion of the cover 702. In such embodiments, the cover 702 may be disposed over at least a portion of the bounce mat 104 utilizing the poles 106 in combination with the cords 802 to retain the cover 702 suspended over at least a portion of the bounce mat 104.

While the above discussed aspects, arrangements, and embodiments are discussed with specific details and particularity, one or more of the components, steps, features and/or functions illustrated in FIGS. 1, 2, 3, 4, 5, 6, 7, 8, and/or 9 may be rearranged and/or combined into a single component, step, feature or function or embodied in several components, steps, or functions. Additional elements, components, steps, and/or functions may also be added or not utilized without departing from the present disclosure.

While features of the present disclosure may have been discussed relative to certain embodiments and figures, all embodiments of the present disclosure can include one or more of the advantageous features discussed herein. In other words, while one or more embodiments may have been discussed as having certain advantageous features, one or more of such features may also be used in accordance with any of the various embodiments discussed herein. In similar fashion, while exemplary embodiments may have been discussed herein as device, system, or method embodiments, it should be understood that such exemplary embodiments can be implemented in various devices, systems, and methods.

The various features associate with the examples described herein and shown in the accompanying drawings can be implemented in different examples and implementations without departing from the scope of the present disclosure. Therefore, although certain specific constructions and arrangements have been described and shown in the accompanying drawings, such embodiments are merely illustrative and not restrictive of the scope of the disclosure, since various other additions and modifications to, and deletions from, the described embodiments will be apparent to one of ordinary skill in the art. Thus, the scope of the disclosure is only determined by the literal language, and legal equivalents, of the claims which follow.

What is claimed is:

1. A trampoline, comprising:

a frame;

a bounce mat coupled to the frame;

a plurality of upright poles coupled to the frame, each upright pole of the plurality of upright poles extending vertically upward at most orthogonal to the bounce mat;

a cover disposed over at least a portion of the bounce mat; and a plurality of cords, each respective cord of the plurality of cords coupled to a respective upright pole of the plurality of upright poles and to a central portion of the cover and extending above and free detached from the cover from the respective upright pole and until the central portion of the cover to which each respective cord is coupled, wherein the cover is retained in an at least partially suspended position by the plurality of upright poles and the plurality of cords, the cover forming a conical shape extending downward and outward from the central portion toward the frame around an entire perimeter of the bounce mat.

2. The trampoline of claim 1, wherein the cover includes a door formed therein.

3. A method of using a trampoline, comprising:

coupling a bounce mat to a frame;

coupling a plurality of upright poles to the frame, each respective upright pole of the plurality of upright poles extending at most orthogonal to the bounce mat;

disposing a cover over at least a portion of the bounce mat; and coupling a respective cord to a respective upright pole of the plurality of upright poles and to a central portion of the cover with the respective cord extending above and free detached from the cover from the respective upright pole and until the central portion of the cover to retain the cover suspended over the at least a portion of the bounce mat, wherein the cover forms a conical shape.

4. The method of claim 3, wherein coupling the bounce mat to the frame comprises:

coupling the bounce mat to the frame utilizing a plurality of springs coupled between the bounce mat and the frame.

* * * * *